US012053077B2

(12) United States Patent
Seguin

(10) Patent No.: US 12,053,077 B2
(45) Date of Patent: Aug. 6, 2024

(54) REFILL FOR COSMETIC PRODUCT RECEPTACLE AND ASSOCIATED RECEPTACLE

(71) Applicant: ALBEA SERVICES, Gennevilliers (FR)

(72) Inventor: Franck Seguin, Gennevilliers (FR)

(73) Assignee: ALBEA SERVICES, Gennevilliers (FR)

( * ) Notice: Subject to any disclaimer, the term of this patent is extended or adjusted under 35 U.S.C. 154(b) by 0 days.

(21) Appl. No.: 18/203,204

(22) Filed: May 30, 2023

(65) Prior Publication Data

US 2023/0389674 A1 Dec. 7, 2023

(30) Foreign Application Priority Data

Jun. 2, 2022 (FR) ..... 2205350

(51) Int. Cl.
*A45D 40/16* (2006.01)
*A45D 40/04* (2006.01)

(52) U.S. Cl.
CPC ..... *A45D 40/16* (2013.01); *A45D 40/04* (2013.01)

(58) Field of Classification Search
CPC ..... A45D 40/16; A45D 40/00; A45D 2040/0025; A45D 2040/0062; A45D 40/04; A45D 40/02; A45D 40/06; A45D 40/205; A45D 2040/208
USPC ..... 401/48, 86, 87, 116, 117, 176
See application file for complete search history.

(56) References Cited

U.S. PATENT DOCUMENTS 2,568,688 A * 9/1951 Shatkin ..... A45D 40/02 401/98
7,021,849 B2 * 4/2006 Ramet ..... A45D 40/262 401/176
2006/0188322 A1 8/2006 Dieudonat
2021/0076803 A1 3/2021 Trochel

FOREIGN PATENT DOCUMENTS

EP 3878310 A1 9/2021
WO 2022076348 A1 4/2022

OTHER PUBLICATIONS

French Patent Application No. FR 2205350, "Search Report", Jan. 20, 2023, 8 pages (No English translation available. A summary of the Search Report is provided in the Transmittal Letter submitted herewith).

* cited by examiner

*Primary Examiner* — David J Walczak
(74) *Attorney, Agent, or Firm* — Kilpatrick Townsend & Stockton LLP

(57) ABSTRACT

A refill is removably mountable on a base of a receptacle of a cosmetic product extend along a main longitudinal axis X. The refill includes a lower sleeve removably attached to the base of the receptacle, a stick of cosmetic product immobile with respect to the lower sleeve, an upper sleeve and at least one intermediate sleeve connecting the upper sleeve and the lower sleeve. The upper sleeve, the at least one intermediate sleeve and the lower sleeve can include first and/or second displacer so that they are rotatably and axially displaceable relative to each other. The first and/or the second displacer for displacing the at least one intermediate sleeve can extend over the entire height of an external and/or internal surface of the at least one intermediate sleeve.

16 Claims, 10 Drawing Sheets

REFILL FOR COSMETIC PRODUCT RECEPTACLE AND ASSOCIATED RECEPTACLE

REFERENCE TO RELATED APPLICATION

This application is based on and claims the benefit of priority from French Patent Application No. 2205350, filed on Jun. 2, 2022, the content of which is incorporated by reference in its entirety.

TECHNICAL FIELD OF THE INVENTION

The invention relates to a refill intended to be removably mounted on a base of a receptacle of a cosmetic product. The invention also relates to a receptacle for cosmetic product comprising such a refill.

The cosmetic product is preferably a deodorant, lipstick or lip balm stick.

TECHNICAL BACKGROUND

Conventionally, the stick products, such as the lipsticks, the lip balm sticks or the deodorant sticks, are packaged in receptacles in which an actuation mechanism allows the product to be applied to be taken out and/or put in.

In general, these receptacles comprise a cup in which the product to be applied is disposed. Upon an actuation of the mechanism, the cup displaces axially relative to an external envelope from a bottom storage position in which it is inserted into the envelope to a top application position in which the product is substantially at the level of an opening in the envelope.

There are several types of mechanisms for actuating the cup.

The cup may, for example, have a central threaded rod passing through it, along which it can move up and/or down. The mechanism is actuated by a knob disposed at the bottom of the mechanism.

The cup may also comprise at least one external lug that displaces in a helical groove. Again, the mechanism is actuated by a knob disposed at the bottom of the mechanism.

These receptacles are complex and require many parts that can move relative to each other.

On the other hand, if the receptacle is opaque, the user has no way of tracking the consumption of the product and may be surprised to run out of product.

In addition, at the end of use, the product is only loosely held by the external envelope and the stick may be removed from the cup.

Finally, the receptacle remains bulky both when the product is new and when it is no longer in use.

There is therefore a need for a solution allowing to solve at least some of the disadvantages mentioned while maintaining a simple design and user-friendly mechanism.

SUMMARY OF THE INVENTION

Thus, the invention relates to a refill intended to be removably mounted on a base of a receptacle of a cosmetic product, said refill extending along a main longitudinal axis X and comprising:

- a lower sleeve configured to be removably attached to the base of the receptacle,
- a stick of cosmetic product that is immobile with respect to the lower sleeve,
- an upper sleeve opposite the lower sleeve,

- at least one intermediate sleeve connecting the upper sleeve and the lower sleeve,
- the upper sleeve, the at least one intermediate sleeve and the lower sleeve comprising first and/or second displacement means such that they are rotatably and axially displaceable relative to each other so as to follow the restitution of the cosmetic product,
- the first and/or the second displacement means for displacing the at least one intermediate sleeve extending over the entire height of an external and/or internal surface of the at least one intermediate sleeve.

A "sleeve" is a cylindrical part with two opposite open axial ends.

A "stick" is a rigid, elongated object. In other words, the cosmetic product is in rigid and elongated form, i.e. extending along a main longitudinal axis coincident with the main axis X of the refill when housed therein.

In other words, the upper, intermediate and lower sleeves are movable relative to each other progressively so as to uncover the cosmetic product as it is consumed. Thus, the upper, intermediate and lower sleeves slide relative to each other until they reach a position where the entire cosmetic product is accessible.

The user can then easily follow the consumption of the cosmetic product.

Moreover, in this refill, unlike the classic mechanism, the cosmetic product remains stationary in relation to the different sleeves. This avoids the risk of deterioration of the stick and ensures that it stays in place from the beginning to the end of its consumption.

According to various embodiments of the invention, which may be taken together or separately:

- the lower sleeve on the base is configured to be axially immobile relative to the base when attached thereto,
- the refill has a fully extended position in which the upper, lower and intermediate sleeves are connected to each other by at least one of their ends,
- in the fully extended position the upper and/or lower ends of the lower sleeve, the upper sleeve and/or the intermediate sleeve are connected to one end of the adjacent sleeve,
- the refill has a fully retracted position in which the sleeves are embedded/nested into each other,
- the refill has at least one intermediate position in which at least two sleeves are at least partly nested into each other,
- the at least one intermediate position allows the transition from the fully extended position to the fully retracted position,
- the upper, lower and intermediate sleeves are secured in the at least one intermediate position, in the fully extended position and in the fully retracted position,
- the first displacement means allow a displacement of the upper sleeve relative to the at least one intermediate sleeve and the second displacement means allow a displacement of the at least one intermediate sleeve relative to the lower sleeve,
- the first displacement means for displacing the upper sleeve are disposed on all or part of an internal surface thereof and cooperates in sliding along a path defined by the first displacement means disposed on the external surface of an adjacent intermediate sleeve,
- the first displacement means for displacing the upper sleeve is disposed on all or part of an external surface thereof and cooperates in sliding along a path defined by the first displacement means disposed on the internal surface of an adjacent intermediate sleeve, the first displacement means for displacing the intermediate sleeve extends over an internal upright of the intermediate sleeve, the intermediate sleeve comprises an internal upright and an external wall, the upper sleeve slides between the internal upright and the external wall of the intermediate sleeve, the first displacement means for displacing the at least one intermediate sleeve is a helical thread, the first displacement means for displacing the upper sleeve is at least one gorge, or at least one rib or at least one lug, the first displacement means for displacing the upper sleeve are three lugs, the first displacement means for displacing the upper sleeve has an angle of inclination similar to an angle of inclination of the path defined by the first displacement means for displacing the adjacent intermediate sleeve, the second displacement means for displacing the lower sleeve are disposed on the external surface thereof and define a path so that the second displacement means for displacing the at least one adjacent intermediate sleeve disposed on all or part of the internal surface thereof cooperate in sliding along this path, the second displacement means for displacing the lower sleeve are disposed on the internal surface thereof and define a path so that the second displacement means for displacing the at least one adjacent intermediate sleeve disposed on all or part of the external surface thereof cooperate in sliding along this path, the second displacement means for displacing the lower sleeve is a helical thread, the second displacement means for displacing the at least one intermediate sleeve is at least one gorge, or at least one rib or at least one lug, the second displacement means for displacing the at least one intermediate sleeve are three lugs, the second displacement means for displacing the intermediate sleeve has an angle of inclination similar to an angle of inclination of the path defined by the second displacement means for displacing the adjacent lower sleeve, the upper sleeve and the adjacent intermediate sleeve comprise first blocking means so as to be secured in rotation, an unblocking being performed by a first torque, the lower sleeve and the adjacent intermediate sleeve comprise second blocking means so as to be secured in rotation, an unblocking being performed by a second torque, the first torque is less than the second torque so that a sequential axial displacement of the sleeves is ensured upon the rotational displacement of at least one of the upper, lower and/or intermediate sleeves, the upper sleeve, the lower sleeve and the at least one intermediate sleeve are made of single material, the refill is made of single material, the single material may be selected from polypropylene, polyterephthalate, post-consumer recycled polypropylene, post-consumer recycled polyterephthalate, or a mixture thereof, the upper sleeve, the lower sleeve and the at least one intermediate sleeve are made of a plastic material selected from polypropylene, polyethylene terephthalate or a mixture thereof, the refill is made of a plastic material selected from polypropylene, polyethylene terephthalate or a mixture thereof, the refill comprises a protective cover removably mounted on the upper sleeve, the first displacement means comprise protrusions allowing the control of the restitution of the cosmetic product, the upper, lower and intermediate sleeves form a transverse wall delimiting a volume V into which the cosmetic product is poured through an open lower end of the lower sleeve, the open lower end of the lower sleeve being sealed by a plug once the cosmetic product has been poured, the upper and lower ends of the at least one intermediate sleeve have sealing areas that cooperate with the upper sleeve and/or the lower sleeve, the cosmetic product is a deodorant product, a lipstick, a balm for the lips, the lower sleeve comprises an axially extending lower internal skirt configured to removably attach with the base of the receptacle, the internal surface of the lower sleeve comprises anti-rotation ridges which extend longitudinally, parallel to each other, so that the lower sleeve and the base of the receptacle are driven in rotation, the internal skirt of the lower sleeve comprises blocking means so as to axially block the refill to the base of the receptacle, the ridges and/or the blocking means are configured to uniquely cooperate with the base of the receptacle the refill comprises an envelope configured to cover at least the at least one intermediate sleeve, the refill comprises an envelope configured to cover at least the lower sleeve, the envelope covers at least the first displacement means for displacing the at least one intermediate sleeve, the envelope covers at least the first displacement means for displacing the lower sleeve, the envelope is configured to cover the upper sleeve, the lower sleeve and the at least one intermediate sleeve, the envelope covers at least the first displacement means and the second displacement means for displacing the upper sleeve, the lower sleeve and the at least one intermediate sleeve, the envelope is an external wall of the at least one intermediate sleeve.

The invention also relates to a receptacle for a cosmetic product comprising a refill as described above and a base allowing for the removable attachment of said refill.

According to various embodiments of the invention, which may be taken together or separately:

the receptacle further comprises a removable cover, the receptacle comprises a coding between the base and the refill so that the base and/or the refill are configured to be specific to each other, the receptacle comprises an envelope configured to cover at least the at least one intermediate sleeve, the receptacle comprises an envelope configured to cover at least the lower sleeve, the envelope covers at least the first displacement means for displacing the at least one intermediate sleeve, the envelope covers at least the first displacement means for displacing the lower sleeve, the envelope is configured to cover the upper sleeve, the lower sleeve and the at least one intermediate sleeve, the envelope covers at least the first displacement means and the second displacement means for displacing the upper sleeve, the lower sleeve and the at least one intermediate sleeve, the envelope is an external wall of the at least one intermediate sleeve.

BRIEF DESCRIPTION OF THE FIGURES

The invention will be better understood, and other characteristics and advantages thereof will become apparent in the course of the detailed description which follows, of at least two examples of embodiment of the invention given by way of purely illustrative and non-limiting examples, with reference to the annexed schematic drawings in which.

DETAILED DESCRIPTION OF THE INVENTION

Figure 1:
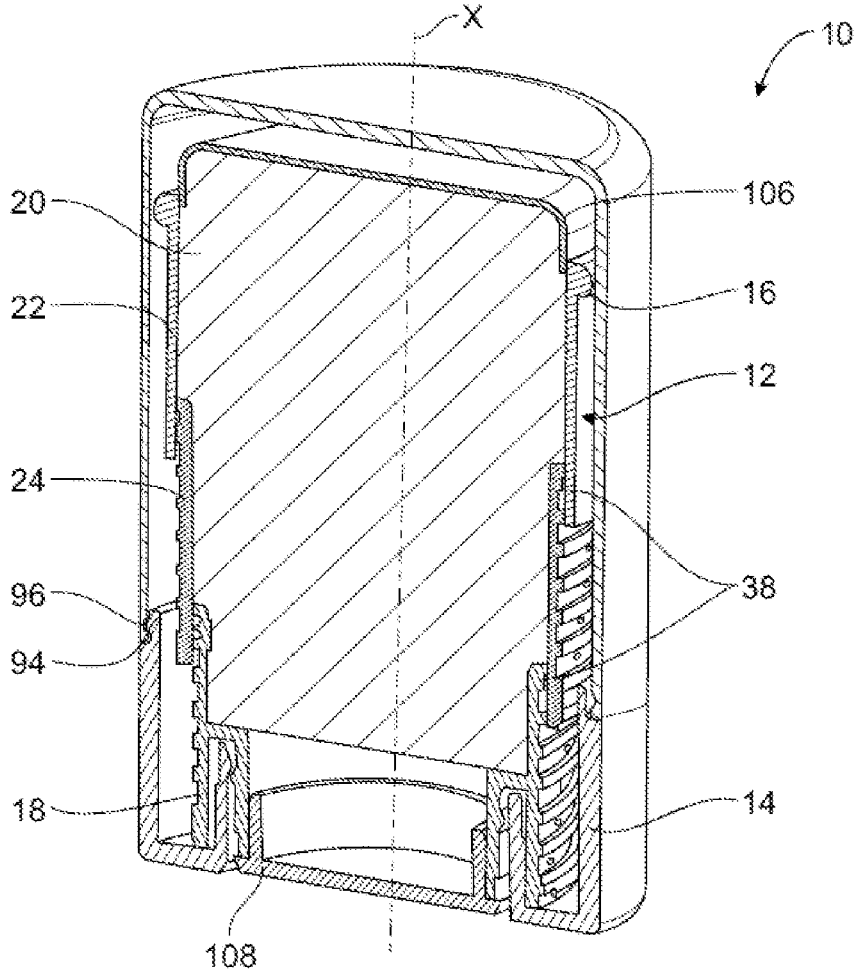
FIG. 1 is a longitudinal sectional view of a receptacle for a cosmetic product comprising a refill according to a first example of the invention in a fully extended position.
Figure 2:
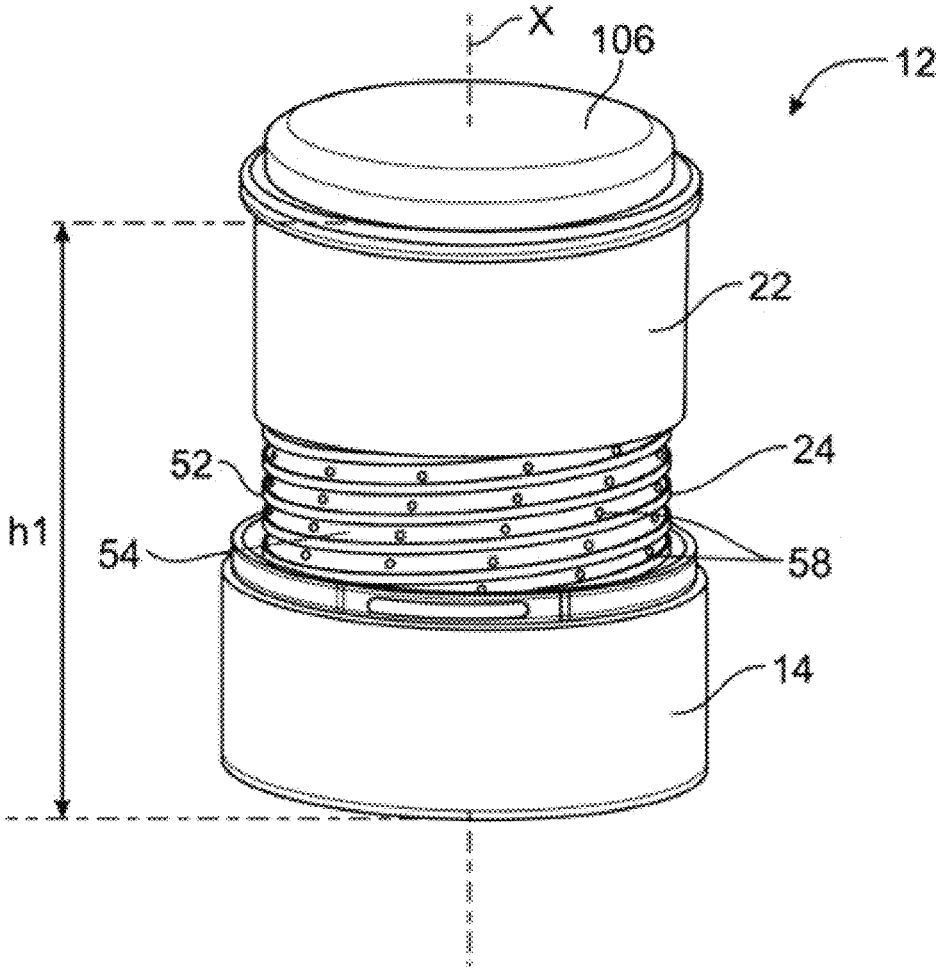
FIG. 2 is a perspective view of the receptacle of FIG. 1 without the cover.
Figure 3:
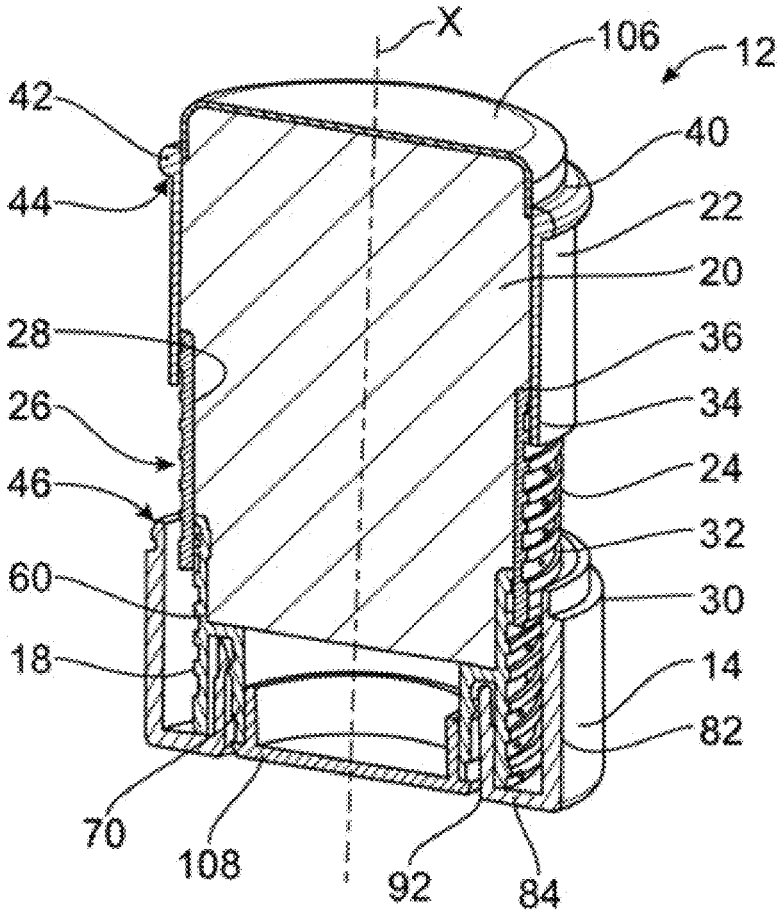
FIG. 3 is a longitudinal sectional view of the receptacle in FIG. 2.
Figure 4:
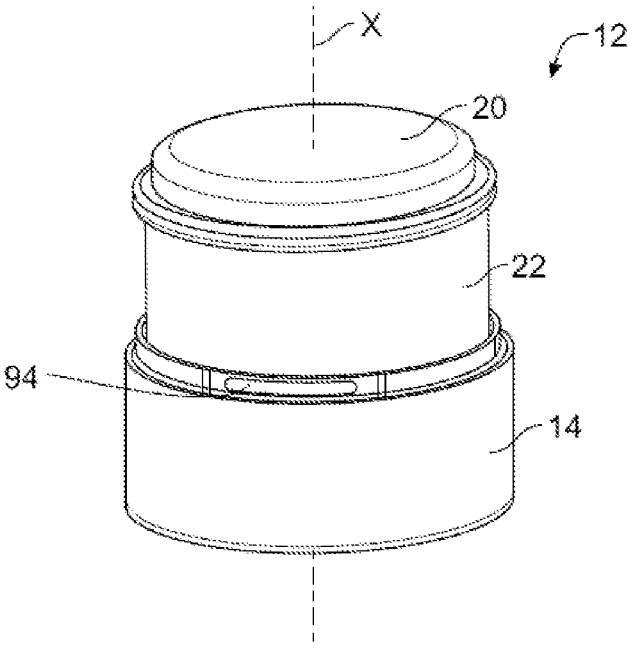
FIG. 4 is a perspective view of the receptacle of FIG. 2 in which the refill is in an intermediate position of use.
Figure 5:
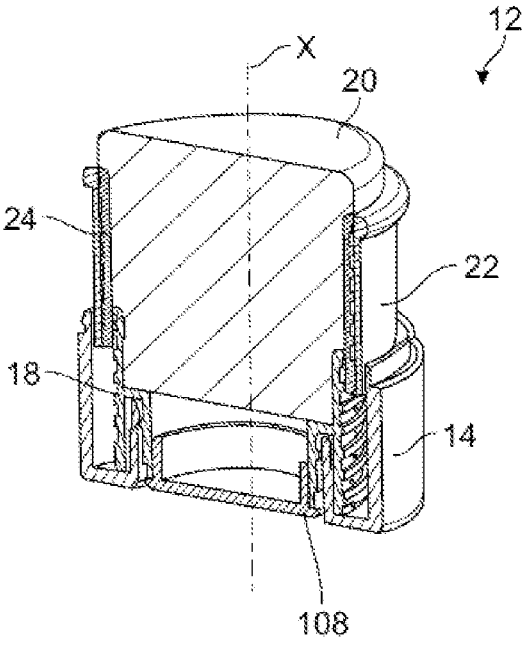
FIG. 5 is a longitudinal sectional view of the receptacle in FIG. 4.

By convention, the "axial" direction in the figures corresponds to that of the main axis X of a receptacle 10 and/or a refill 12 intended to be removably mounted in the receptacle 10, and the "radial" direction is orthogonal to the axial direction.

In the following detailed description of the figures, the terms "upper" and "lower" or "top" and "bottom" will be used without limitation in reference to the axial direction.

Similarly, the terms "outer or external" and "inner or internal" are used with reference to the radial direction, an outer element being radially further from the axis X than an inner element.

FIGS. 1 to 15 illustrate three examples of a refill 12 according to the invention intended to be removably mounted in a receptacle 10.

In these examples of embodiments, the receptacle 10 comprises a refill 12 extending along a longitudinal principal axis X, a base 14 allowing for the removable attachment of said refill 12 and a removable cover 16.

Generally, the cover 16 is associated with the base 14 which together define an external outline of the receptacle 10.

In the examples shown, in a non-limiting manner, the cover 16, the base 14 of the receptacle 10 and the refill 12 have a cylindrical shape with a circular cross section.

Preferably, the cover 16 is removable. The cover 16 is likely to occupy at least one open position in which the cover 16 is separated from the base 14 with a view in particular to allowing the cosmetic product to be applied, and a closed position in which the cover 16 is secured to the base 14.

The refill 12 comprises:

a lower sleeve 18 configured to be removably attached to the base 14 of the receptacle 10, a stick 20 of cosmetic product that is immobile with respect to the lower sleeve 18, an upper sleeve 22 opposite the lower sleeve 18, at least one intermediate sleeve 24 connecting the upper sleeve 22 and the lower sleeve 18.

According to the invention, the upper sleeve 22, the at least one intermediate sleeve 24 and the lower sleeve 18 comprise first and/or second displacement means such that they are rotatably and axially displaceable relative to each other so as to follow the restitution of the cosmetic product.

The first and/or the second displacement means for displacing the at least one intermediate sleeve 24 extend over the entire height H of an external 26 and/or internal 28 surface of the at least one intermediate sleeve 24.

A "sleeve" is a cylindrical part with two opposite open axial ends.

A "stick" is a rigid, elongated object. In other words, the cosmetic product is in rigid form and elongated form, i.e. extending along a main longitudinal axis coincident with the main axis X of the refill 12 when housed therein.

In this example of embodiment, the refill 12 comprises a single intermediate sleeve 24.

In other examples of embodiment, the refill 12 may comprise two or even three or even four intermediate sleeves 24. The number of intermediate sleeves 24 allows the size of the refill 12 to be adjusted, in particular to have a higher refill 12 and thus a longer stick 20 of cosmetic product for a large number of intermediate sleeves 24 and a shorter refill 12 with a shorter stick 20 of cosmetic product.

Advantageously, once the refill 12 is inserted on the base 14, the lower sleeve 18 is axially immobile with respect to the base. This axial immobility is temporary while the refill 12 is used with the base 14.

"Immobile" means not displacing, not moving at all. In other words, the stick 20 of cosmetic product housed in the refill does not displaces relative to the lower sleeve 18, unlike the conventional cosmetic product mechanisms of this type in which the cosmetic product displaces relative to the bottom of the receptacle/of the refill, in particular by means of a cup that can move up or down.

Advantageously, at least the upper sleeve 22, the lower sleeve 18 and the at least one intermediate sleeve 24 are made of single material. In other words, the refill 12 is preferably made of a single material.

Advantageously, the receptacle 10 can also be made of a single material, i.e. the refill 12, the base 14 and the cover 16 are made of a same material.

A single material means the design of one or more elements from a single material.

The use of a single material, or at least similar materials, to make the various parts of the refill 12 and/or the receptacle 10 is particularly interesting for their recycling after use of the cosmetic product. Indeed, the presence of different materials presents disadvantages during the recycling where the parts must be separated. The use of a single material means that all parts of the refill 12 can be disposed of together without having to dismantle it, thus facilitating the recycling.

The single material may be selected from polypropylene (PP), polyethylene terephthalate (PET), recycled polyethylene terephthalate (R-PET), thermoplastic elastomer (TPE), polyethylene (PE), such as low density polyethylene (LDPE) and/or high density polyethylene (HDPE), composite material, post-consumer recycled (PCR) material and/or a similar material.

Preferably, the single material is selected from polypropylene, polyterephthalate, post-consumer recycled polypropylene, post-consumer recycled polyterephthalate, or a mixture thereof.

Polypropylene and polyethylene terephthalate are two plastic materials whose recycling cycle is well known.

Advantageously, the upper 22, lower 18 and intermediate 24 sleeves are axially and rotatably movable relative to each other so that the refill 12 has a fully extended position, a fully retracted position and at least one intermediate position allowing for moving from the fully extended position to the fully retracted position.

In the fully extended position shown in FIGS. 1 to 3, 13 and 14, the upper 22, lower 18 and intermediate 24 sleeves are connected to each other by at least one end.

This fully extended position corresponds to the position in which the refill 12 is located when it is new, for example, and the cosmetic product has not yet been used. In this position, the refill 12 has the greatest possible height h1.

In other words, an upper end 30 of the lower sleeve 18 is connected to a lower end 32 of the adjacent intermediate sleeve 24 and the lower end 34 of the upper sleeve 22 is connected to an upper end 36 of the adjacent intermediate sleeve 24. That is, in the case of a single intermediate sleeve 24 as illustrated, the upper end 36 of the intermediate sleeve 24 is connected to the lower end 34 of the upper sleeve 22 and the lower end 32 of the intermediate sleeve 24 is connected to the upper end 30 of the lower sleeve 18.

In the case of a refill 12 comprising a plurality of intermediate sleeves 24, on the same principle, in the fully extended position, an upper end of an intermediate sleeve 24 is connected to a lower end of the adjacent intermediate sleeve 24 located above and a lower end of that intermediate sleeve 24 is connected to an upper end of the adjacent intermediate sleeve 24 located below.

Figure 6:
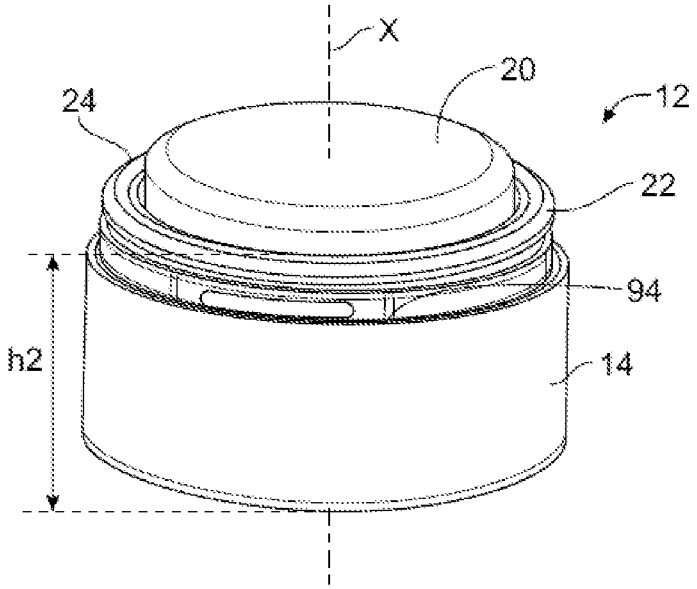
FIG. 6 is a perspective view of the receptacle of FIG. 2 in which the refill is in a fully retracted position.
Figure 7:
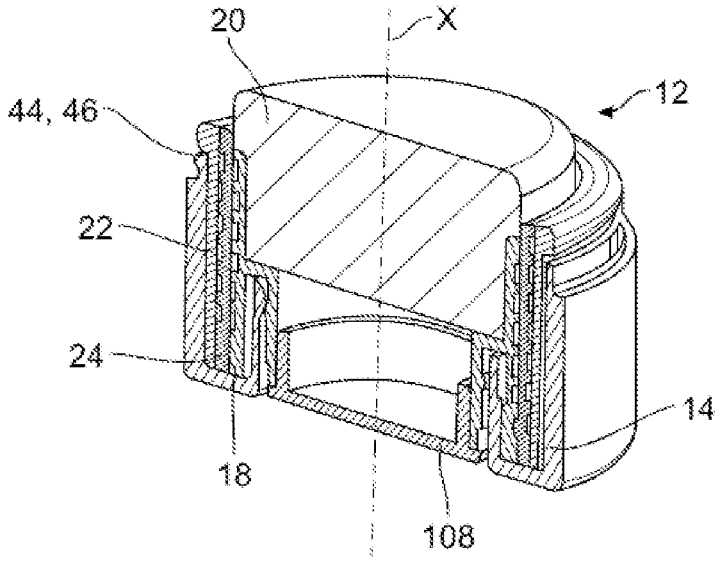
FIG. 7 is a longitudinal sectional view of the receptacle in FIG. 6.
Figure 15:
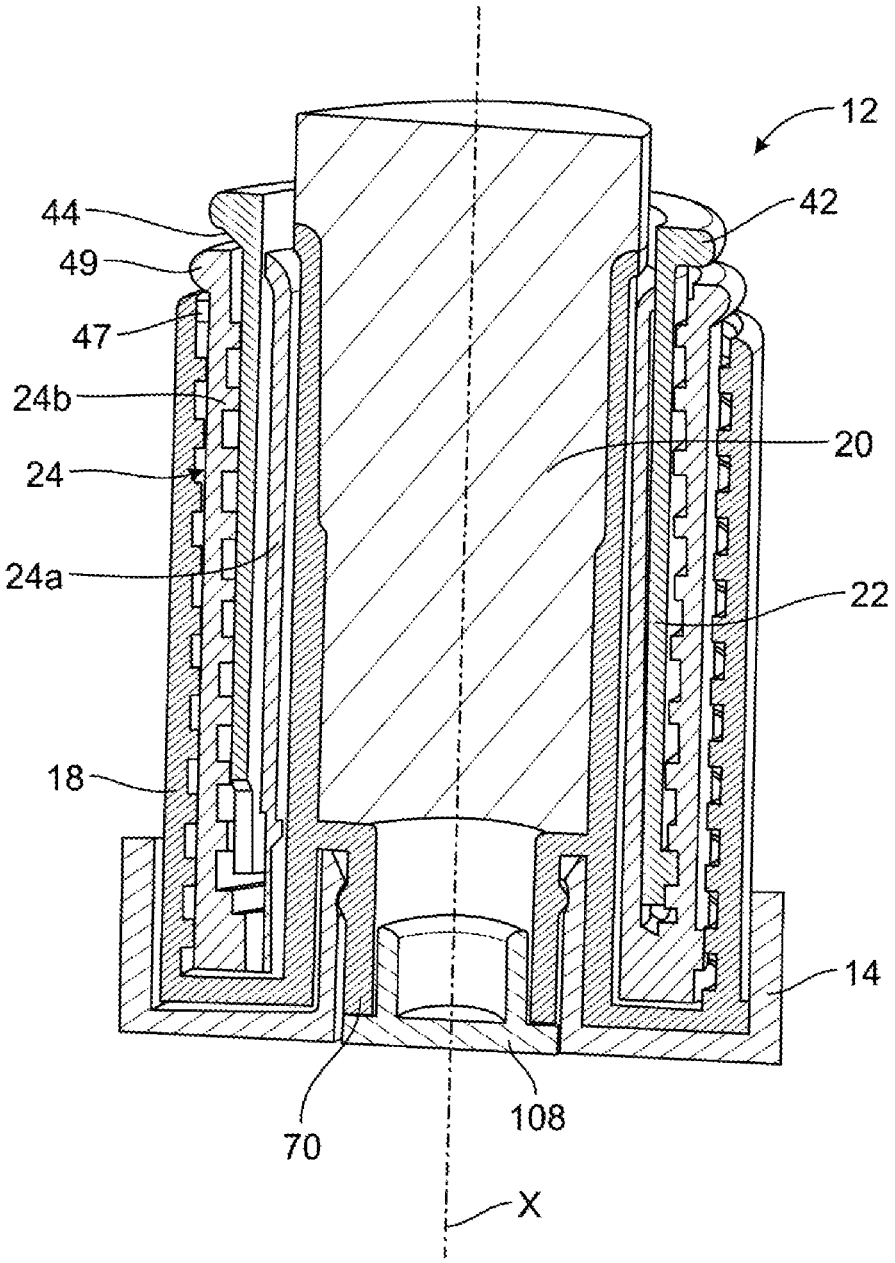
FIG. 15 is a longitudinal sectional view of the receptacle of FIG. 14 in which the refill is in a fully retracted position.

In the fully retracted position shown in FIGS. 6, 7 and 15, the upper 22, lower 18 and intermediate 24 sleeves are embedded/nested into each other. In other words, the upper 22, lower 18 and intermediate 24 sleeves are disposed concentrically to the axis X.

This fully retracted position corresponds to the position in which the refill 12 is located when all the cosmetic product is used, for example. In this position, the refill 12 has the smallest possible height h2.

In order to move from the fully extended position to the fully retracted position, the refill 12 has intermediate positions in which at least two sleeves 18, 22, 24 are at least partly embedded within each other. In other words, at least two sleeves 18, 22, 24 are partly retracted.

Advantageously, the upper 22, lower 18 and intermediate 24 sleeves are secured to the at least one intermediate position, in the fully extended position and in the fully retracted position, i.e. in any position.

Advantageously, a hermetic area 38 is formed between each sleeve. In the illustrated embodiment, the hermetic areas 38 are a hermetic annulus formed between the upper sleeve 22 and the intermediate sleeve 24 and/or between the intermediate sleeve 24 and the lower sleeve 18.

Figure 13:
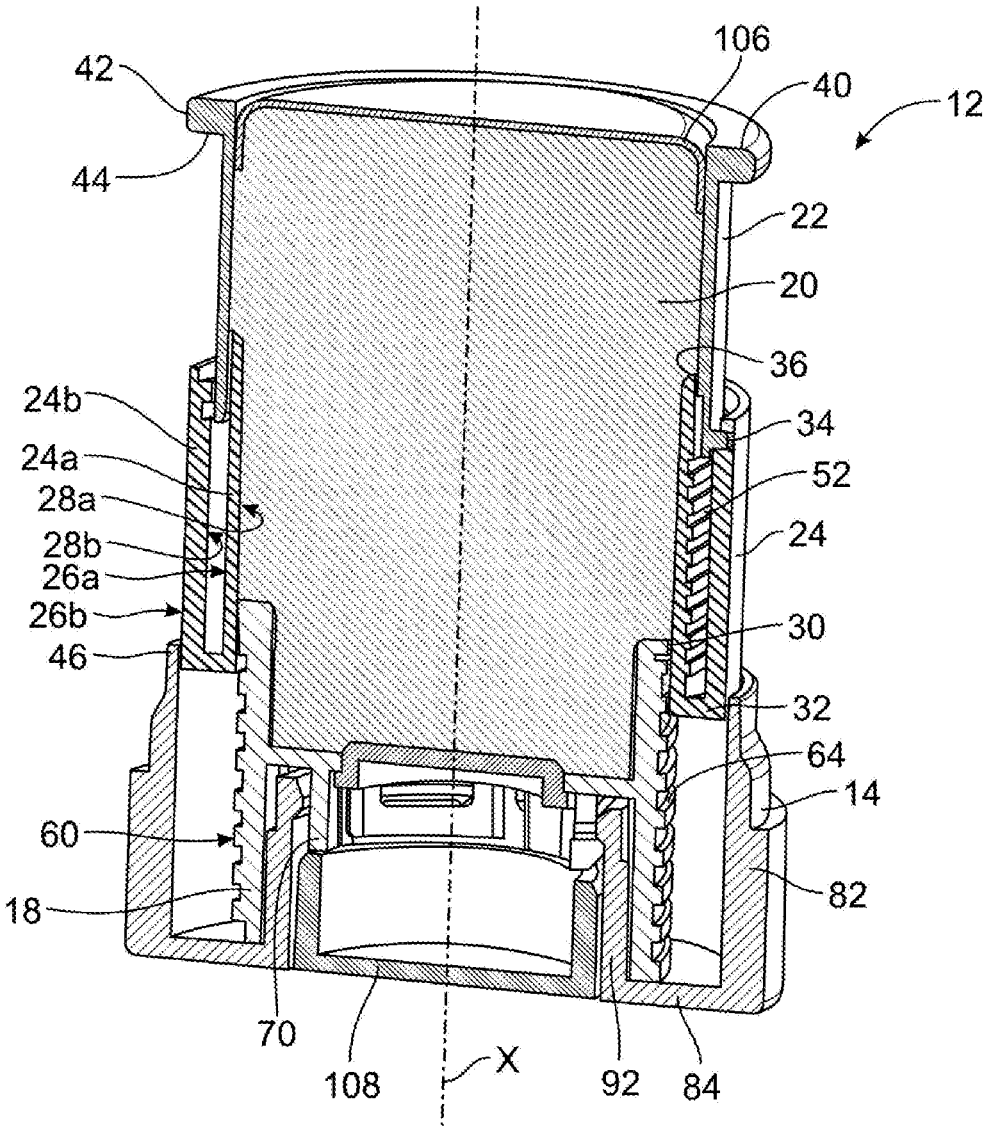
FIG. 13 is a perspective view of a receptacle for a cosmetic product comprising a refill according to a second example of the invention in a fully extended position without the cover.
Figure 14:
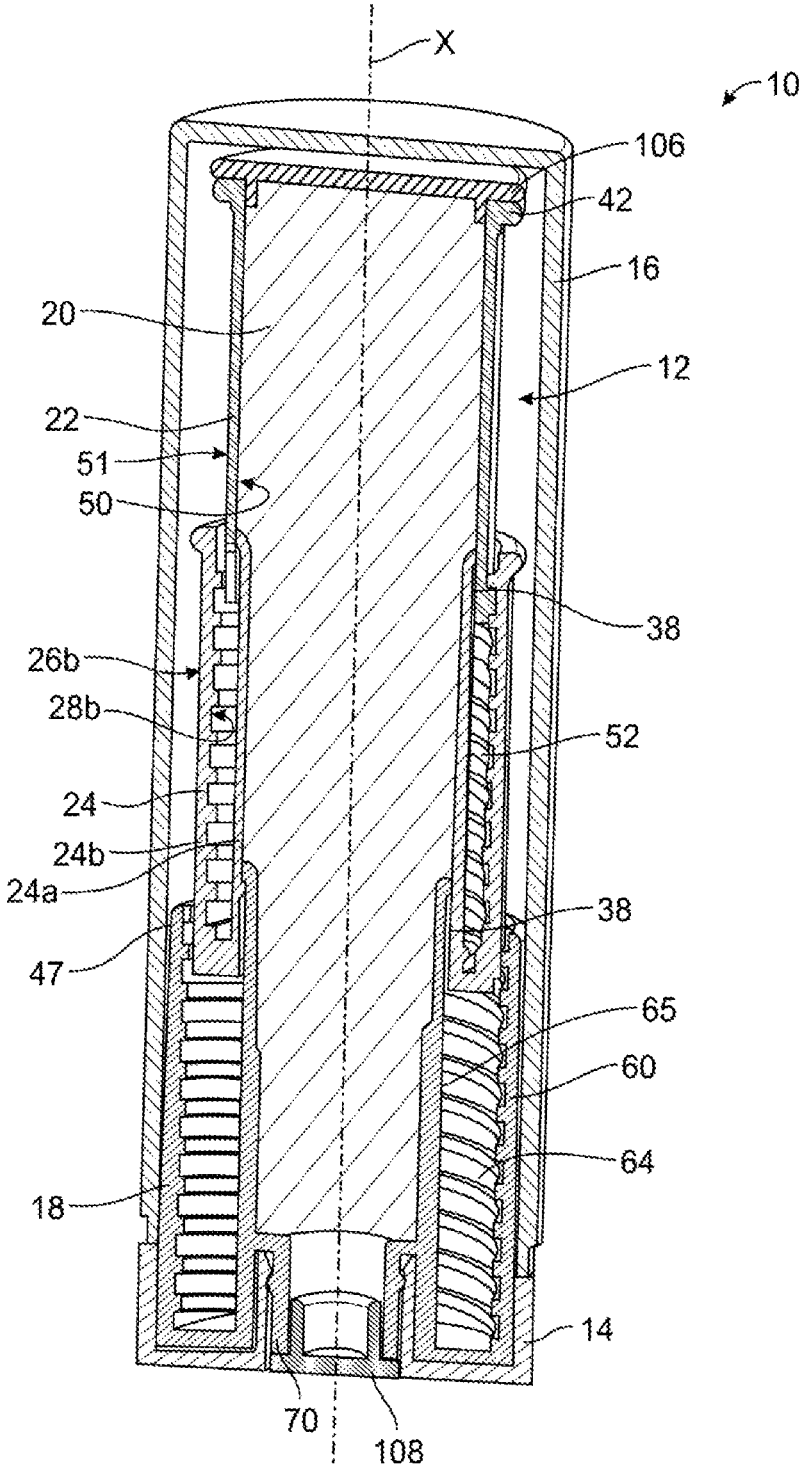
FIG. 14 is a longitudinal sectional view of a receptacle for a cosmetic product comprising a refill according to a third example of the invention in a fully extended position.

Thus in these examples of the embodiment, in the fully extended position shown in FIGS. 1, 13 and 14, the intermediate sleeve 24 lies axially between the upper sleeve 22 and the lower sleeve 18.

In the fully retracted position shown in FIG. 7, the intermediate sleeve 24 lies radially between the upper sleeve 22 and the lower sleeve 18.

In another embodiment illustrated in FIG. 13, the receptacle 10, here the refill 12, comprises an envelope configured to cover at least the at least one intermediate sleeve 24.

The receptacle 10 or the refill 12 may also comprise an envelope configured to cover at least the lower sleeve 18.

Advantageously, the envelope covers at least the first displacement means for displacing the at least one intermediate sleeve and/or the lower sleeve.

The envelope may be an additional external part, for example connected to the intermediate sleeve 24 or to the lower sleeve 18.

In the second example shown in FIG. 13, the intermediate sleeve 24 is U-shaped and comprises an internal upright 24*a* and an external upright 24*b* corresponding to the envelope. In such an embodiment, the upper sleeve 22 may, for example, slide between the two uprights 24*a*, 24*b*, as is the case here.

In the third example shown in FIG. 14, the intermediate sleeve 24 is also U-shaped and comprises an internal upright 24*a* and an external upright 24*b* corresponding to the envelope. The upper sleeve 22 slides between the two uprights 24*a*, 24*b*, as seen in FIG. 15.

Figure 8:
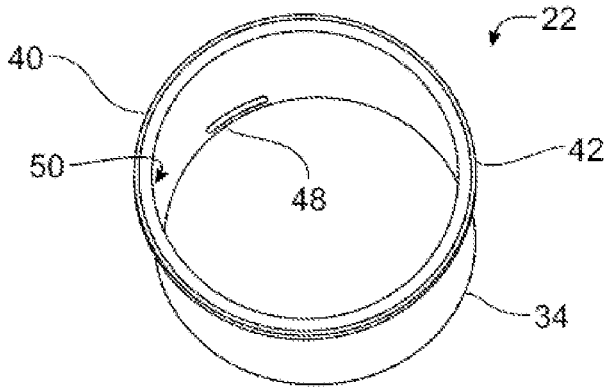
FIG. 8 is a perspective view of the upper sleeve of the receptacle of FIG. 1.

In these examples of embodiment illustrated herein, the upper sleeve 22, an example of which is visible in FIG. 8, has a tubular wall that extends along the axis X from an open upper end 40 to an open lower end 34. In other words, this is a cylindrical element with a circular cross section.

Alternatively, not shown, the cross-section may have another shape, for example polygonal.

The open upper end 40 of the upper sleeve 22 comprises a collar 42 which projects radially outwards with respect to the top sleeve 22. The collar 42 forms an annular-shaped lower shoulder face 44 serving, for example, as an abutment when the refill 12 is in a fully retracted position.

The collar 42 is also used as a gripping means when handling the rotation of the sleeves 18, 22, 24.

The collar 42 thus has a larger diameter, in particular larger than that of the base 14 and/or the intermediate or lower sleeves 24, 18 so that a gripping surface for lowering the upper sleeve 22 and/or the intermediate sleeve 24 is always maintained. In other words, even when the refill 12 is in the fully retracted position, the collar 42 remains accessible in relation to the diameter of the base 14.

Advantageously, in the fully retracted position, the lower shoulder face 44 is in contact with an upper rim 46 of the base 14 or in contact with an upper rim 47 of the lower sleeve 18 or in contact with an upper rim 49 of the intermediate sleeve 24.

In the first and second examples of embodiment, the upper sleeve 22 further comprises three ribs 48 disposed on an internal surface 50 of the tubular wall and projecting radially inwardly from the upper sleeve 22.

In the third example of embodiment, the ribs 48 are disposed on an external surface 51 of the tubular wall and project radially outwards from the upper sleeve 22.

The ribs 48 are the first displacement means for displacing the upper sleeve 22 and allow a displacement of the upper sleeve 22 relative to the adjacent intermediate sleeve 24.

The ribs 48 are evenly spaced at an angle of 120°.

Advantageously, the ribs 48 of the upper sleeve 22 extend angularly along the internal surface 50 thereof.

Furthermore, the ribs 48 of the upper sleeve 22 have an angle of inclination. In other words, the ribs 48 are not parallel to a plane parallel to a transverse plane of the refill 12.

Figure 9:
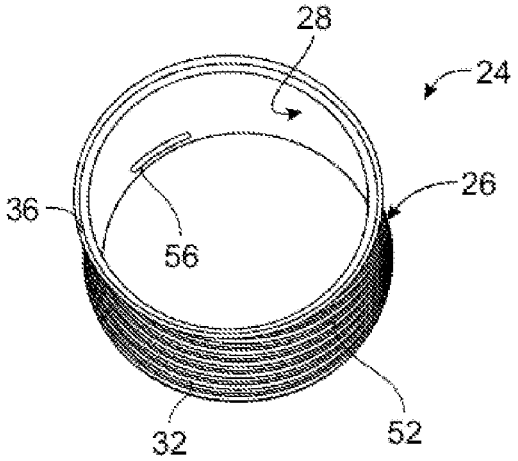
FIG. 9 is a perspective view of the intermediate sleeve of the receptacle of FIG. 1.

Like the upper sleeve 22, the intermediate sleeve 24, an example of which is shown in FIG. 9, has a tubular wall extending along the axis X from the open upper end 36 to the open lower end 32. In other words, this is a cylindrical element with a circular cross section.

Alternatively, not shown, the transversal cross-section may have another shape, for example polygonal.

In the first example of embodiment, the external surface 26 of the tubular wall is provided with a thread 52 extending over the entire height of the intermediate sleeve 24. The thread 52 and the first displacement means for displacing the intermediate sleeve 24 allow a displacement of the upper sleeve 22 relative to the adjacent intermediate sleeve 24.

The thread has a helical groove 54 defining a path with which the ribs of the upper sleeve 22 cooperate so that the upper sleeve 22 slides relative to the adjacent intermediate sleeve 24.

Advantageously, the helical groove 54 has an angle of inclination substantially similar to the angle of inclination of the ribs 48 of the adjacent upper sleeve 22.

In the first example of embodiment, the intermediate sleeve 24 further comprises three ribs 56 disposed on the internal surface 28 of the tubular wall and projecting radially inwardly from the intermediate sleeve 24.

In the second example of embodiment, the ribs 56 are disposed on the internal surface 28*a* of the internal upright 24*a* of the intermediate sleeve 24 and project radially inwardly from the intermediate sleeve 24.

In the third example of embodiment, the ribs 56 are disposed on an external surface 26*b* of the external upright 24*b* of the tubular wall of the intermediate sleeve 24 and project radially outwardly from the intermediate sleeve 24.

The ribs are the second displacement means for displacing the intermediate sleeve 24 and allow a displacement of the intermediate sleeve 24 relative to the lower sleeve 18.

The ribs 56 are evenly spaced at an angle of 120°.

The helical groove 54 comprises regularly spaced protrusions 58 along its length and allowing the control of the restitution of the cosmetic product. The protrusions cooperate with the ribs 48 of the adjacent upper sleeve 22 and create a point of resistance, which is felt, in particular, by the user when the upper sleeve 22 is rotated so that the cosmetic product appears.

In the third example of embodiment shown in FIG. 14, the first displacement means for displacing the intermediate sleeve 24, such as a thread 52, is located on the internal surface 28 of the tubular wall of the intermediate sleeve 24. This allows to improve the external appearance of the refill by making the first displacement means for displacing the intermediate sleeve 24 invisible In particular, in the event that the intermediate sleeve 24 is U-shaped as shown in FIG. 13, an internal surface 28*b* of the external upright 24*b* comprises the first displacement means and an internal surface 26*a* of the internal upright 24*a* comprises the second displacement means for displacing the intermediate sleeve 24 relative to the lower sleeve 18 or with respect to an adjacent intermediate sleeve.

Figure 10:
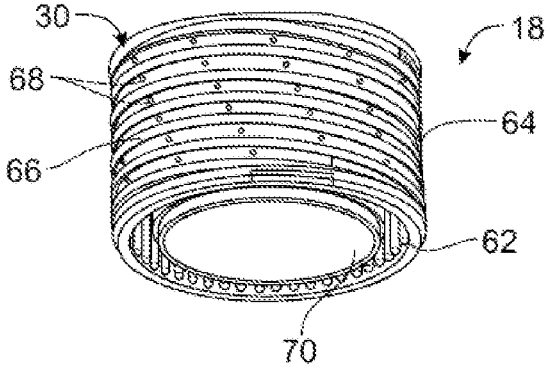
FIG. 10 is a perspective view of the lower sleeve of the receptacle in FIG. 1.
Figure 11:
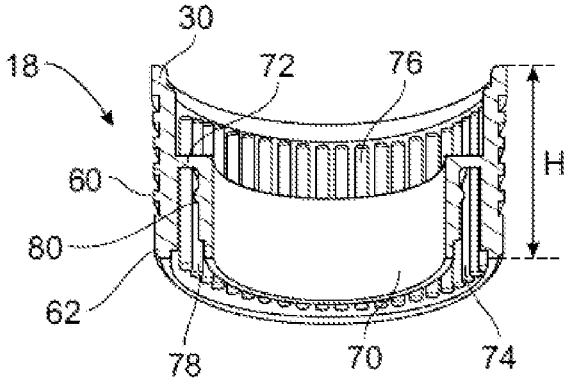
FIG. 11 is a longitudinal sectional view of the lower sleeve of FIG. 10.

In these examples of embodiments, the lower sleeve 18, an example of which can be seen in FIGS. 10 and 11, has a tubular external wall 60 which extends along the axis X from the open upper end 30 to an open lower end 62. In other words, this is a cylindrical element with a circular cross section.

Alternatively, not shown, the transversal cross-section may have another shape, for example polygonal.

In the first and second examples of embodiment, the external wall 60 has an external surface provided with a thread 64 extending over the entire height H. The thread 64 is the second displacement means for displacing the lower sleeve 18 allowing a displacement of the adjacent intermediate sleeve 24 relative to the lower sleeve 18.

In the third example of embodiment, the thread 64 extends over the entire height H of an external surface of the external wall 60.

In the third example of embodiment, the lower sleeve 18 further comprises an inner upright 65. The intermediate sleeve 24 slides between the internal upright 65 and the external wall 60 of the lower sleeve 18.

The thread 64 has a helical groove 66 defining a path with which the ribs 56 of the adjacent intermediate sleeve 24 cooperate so that the adjacent intermediate sleeve 24 slides relative to the lower sleeve 18.

Advantageously, the helical groove 66 has an angle of inclination substantially similar to the angle of inclination of the ribs 56 of the adjacent intermediate sleeve 24.

The helical groove 66 comprises regularly spaced protrusions 68 along its length to allow the control of the restitution of the cosmetic product. The protrusions 68 cooperate with the ribs 56 of the adjacent intermediate sleeve 24 and create a point of resistance, which is felt, in particular, by the user when he or she rotates the intermediate sleeve 24 so that the cosmetic product appears.

In the examples shown, the lower sleeve 18 further comprises an internal skirt 70 extending axially from an internal shoulder 72 projecting from the internal surface of the external wall 60 of the sleeve towards the lower end 62 of the lower sleeve 18.

In the first and second examples of embodiment, the internal shoulder 72 is located equidistant from the lower end 62 and from the upper end 30 of the external wall 60.

The internal skirt 70 and the external wall 60 thus form an annular housing 74 in which the base 14 is housed.

The internal skirt 70 is thus configured to be removably attached to the base 14 of the receptacle 10.

An upper portion of the internal surface of the external wall 60 comprises longitudinal ridges 76 which extend parallel to each other, herein over the full height extending from the upper end of the external wall towards the internal shoulder 72. These ridges 76 allow the cosmetic product housed in the refill 12 to be blocked against rotation.

A lower portion of the internal surface of the external wall 60 forms an internal surface of the housing 74. This internal surface comprises anti-rotation ridges 78 which extend longitudinally, parallel to each other, here over the full height extending from the lower end of the external wall to the internal shoulder 72. These ridges 78 allow the lower sleeve 18 and the base 14 to be driven in rotation.

Advantageously, the internal skirt 70 comprises a bead 80 extending annularly on the external surface of the internal skirt 70. The bead 80 cooperates with the base 14 so as to block any axial movement between the lower sleeve 18 and the base 14, in other words between the refill 12 and the base 14.

Figure 12:
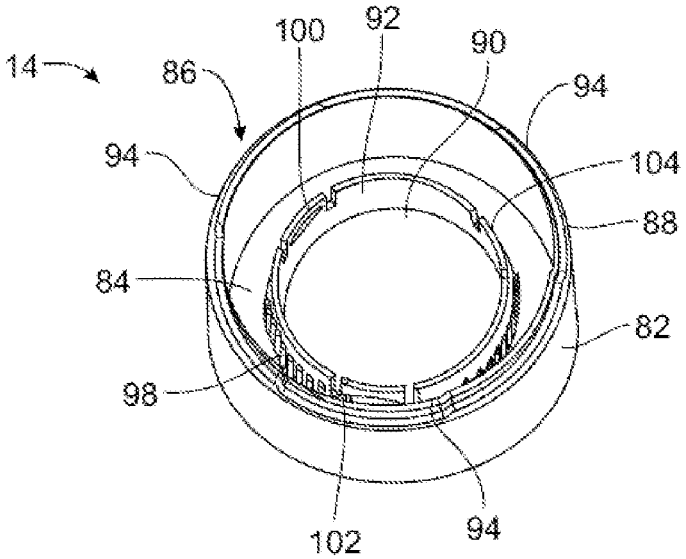
FIG. 12 is a perspective view of the base of the receptacle in FIG. 1.

In the illustrated examples of embodiment, the base 14, visible in FIG. 12 for the first example, comprises a longitudinal wall 82 extending from a transverse lower bottom 84 to an open upper end 86 delimited by an upper edge 88.

The lower base 84 comprises a circular opening 90 delimited by an external periphery from which an internal skirt 92 extends projecting towards the upper end 86 of the base 14.

Advantageously, as illustrated in FIG. 1, the upper edge 88 of the longitudinal wall 82 comprises at least one angularly extending extra thickness 94. The extra thicknesses 94 are designed to cooperate with a lower edge of the cover 16, more particularly with an annular gorge 96 extending around the circumference of the lower edge of the cover 16, and to allow it to be held axially.

In this example of embodiment the upper edge 88 comprises three extra thicknesses 94 evenly spaced at an angle of 120°.

In other examples of embodiment not shown, the upper edge 88 may comprise two, or even four, or even five, or even six extra thicknesses 94. Advantageously, in order to balance the closure of the receptacle 10 by the cover 16, the extra thicknesses 94 are evenly distributed around the circumference of the upper edge 88.

Alternatively, the cover 16 can be held in place by cooperation of the cover 16 with the lower sleeve 18, in particular with an extra thickness of the external surface of the external wall 60 of the lower sleeve 18 as in the third example in FIG. 14.

The internal skirt 92 of the base 14 comprises an internal surface provided with longitudinal ridges 98 designed to cooperate with the longitudinal ridges 78 of the lower sleeve 18. These ridges 98 on the base 14 are designed to cooperate with the anti-rotation ridges 78 on the lower sleeve 18 and allow the lower sleeve 18 and the base 14, i.e. the refill 12 and the base 14, to be rotated.

Advantageously, the internal skirt 92 of the base 14 comprises blocking means so as to axially block the lower sleeve 18 to the base 14, i.e. the refill 12 to the base 14 of the receptacle 10.

In this example of embodiment, the blocking means are at least one tongue 100 having a transversal elasticity formed by slots 102 located on an upper edge of the internal skirt 92 of the base 14.

Advantageously, each of the tongues 100 comprises a bead 104 projecting radially outwards from the base 14. Each bead of the tongues 100 cooperates with the bead 80 of the internal skirt 70 of the lower sleeve 18 so as to axially block the lower sleeve 18 to the base 14, i.e. the refill 12 to the base 14 of the receptacle 10.

The example of embodiment of the base shown in FIG. 12 comprises three evenly spaced tongues 100.

In other examples of embodiment not shown, the upper edge of the internal skirt 92 may comprise two or even four or even five or even six tongues 100. Advantageously, to balance the retention of the lower sleeve 18 on the base 14, i.e. the refill 12 on the base 14, the tongues 100 are evenly distributed around the circumference of the upper edge of the internal skirt 92 of the base 14.

The radial elasticity of the tongues 100 allows to facilitate the insertion of the refill 12 into the base 14.

The upper 22, lower 18 and intermediate 24 sleeves are assembled so as to form a refill 12. In particular, the upper 22, lower 18 and intermediate 24 sleeves form in particular an internal volume in which the cosmetic product is housed, here in the form of a stick 20.

For this purpose, the ribs 48, 56 of the upper sleeve 22 and the intermediate sleeve 24 cooperate with the threads 52, 64 of the intermediate sleeve 24 and of the lower sleeve 18 respectively.

Once assembled, advantageously, the refill 12 can be loaded with cosmetic product through the open lower end 62 of the lower sleeve 18 so as to form the stick 20 of cosmetic product. For this purpose, preferably the open upper end 40 of the upper sleeve 22 is closed by a protective cover 106 removably mounted on the upper sleeve 22.

The protective cover 106 allows to protect the surface of the stick 10 of cosmetic product, particularly when stored in a receptacle prior to use. The protective cover 106 thus allows to limit a deformation and/or a deterioration of the stick and to ensure its protection, in particular hygienic protection, before use.

Preferably, the protective cover 106 is disposable. In other words, the protective cover 106 is removed and discarded after the first use of the cosmetic product, i.e. when the refill 12 is mounted on the base 14 of the receptacle 10.

However, the protective cover 106 can be retained for later use, for example if the cosmetic product requires a further protection.

Advantageously, the protective cover 106 is made of disposable material. This could be paper or a recyclable material, for example.

The refill 12 can also be loaded with cosmetic product through the open upper end 40 of the upper sleeve 22. For this purpose the open lower end 62 of the lower sleeve 18 is sealed. Advantageously, the open lower end of the lower sleeve 18 is closed by a removably mounted plug 108.

The operation of the receptacle 10 will now be explained.

First, the user attaches the refill 12 to the base 14 of the receptacle 10. The receptacle 10 can be advantageously closed by the removable cover 16.

In this step, the internal skirt 92 of the base 14 is housed into the annular housing 74 formed by the internal skirt 70 and the external wall 60 of the lower sleeve 18.

The bead 80 of the external surface of the internal skirt 70 of the lower sleeve 18 cooperates with the beads 104 of the tongues 100 of the internal skirt 92 of the base 14 so as to block any axial movement between the lower sleeve 18 and the base 14, i.e. between the refill 12 and the base 14.

Advantageously, the anti-rotation ridges 78, 98 and/or the blocking means 80, 104 for blocking the lower sleeve 18 and/or the base 14 may be configured to have a unique cooperation between the lower sleeve 18 and the base 14, i.e. between the refill 12 and the base 14 of the receptacle 10, so as to allow the refill 12 to be mounted on the base 14.

"Allowing the refill 12 to be mounted on the base 14" is understood to mean a complete mounting and not a partial association which might be sufficient to actuate the refill 12 under non-nominal conditions, i.e., in particular, without attaching the refill 12 on the base 14. This allows to avoid an assembly of the refill 12 on a wrong base 14 with deterioration of one and/or the other and ensures a uniqueness and a functional control of the product.

The receptacle may thus comprise a coding between the base and the refill so that the base and/or the refill are configured to be specific to each other.

Then, after removing the cover 16, the user can apply the cosmetic product.

For this purpose, if not accessible, the upper, intermediate and lower sleeves 22, 24, 18 are rotated relative to each other, causing an axial movement of the sleeves relative to each other so as to accompany and follow the restitution of the cosmetic product.

Advantageously, in a first step the upper sleeve 22 is actuated relative to the intermediate sleeve 24, until the upper sleeve 22 comes to envelop the intermediate sleeve 24. In this intermediate position, the upper sleeve 22 is located around the intermediate sleeve 24. This position can be seen in FIGS. 4 and 5.

Finally, advantageously, the intermediate sleeve 24 is actuated relative to the lower sleeve 18, also driving the upper sleeve 22, until the upper sleeve 22 and the intermediate sleeve 24 come to envelop the lower sleeve 18. The refill 12 is then in a fully retracted position in which the upper sleeve 22 and the intermediate sleeve 24 are around the lower sleeve 18. This position can be seen in FIGS. 6 and 7. In this position, the cosmetic product is fully consumed.

In the case of several intermediate sleeves 24 not shown, each intermediate sleeve 24 is lowered as the cosmetic product is consumed. The highest intermediate sleeve 24, i.e. adjacent to the upper sleeve 22, is then actuated first and the lowest intermediate sleeve 24, i.e. adjacent to the lower sleeve 18, is actuated last.

Advantageously, to facilitate the actuation of the sleeves in relation to each other, each sleeve has a different unblocking torque. The upper sleeve 22 and the adjacent intermediate sleeve 24 are unblocked by a first torque C1, and the intermediate sleeve 24 and the adjacent intermediate sleeve 24 are unblocked by a second torque C2.

Preferably, the first torque C1 is less than the second torque C2 so that a sequential axial displacement of the sleeves is ensured during the rotational displacement of the upper, lower and/or intermediate sleeves 22, 18, 24.

In the case of several intermediate sleeves 24, which are not shown, the unblocking of the intermediate sleeves 24 from each other is also advantageously performed with different torques Cn.

The invention claimed is:

1. A refill to be removably mounted on a base of a receptacle of a cosmetic product, said refill extending along a main longitudinal axis X and comprising:

a lower sleeve configured to be removably attached to the base of the receptacle, a stick of cosmetic product immobile with respect to the lower sleeve, an upper sleeve opposite the lower sleeve, at least one intermediate sleeve connecting the upper sleeve and the lower sleeve, the upper sleeve, the at least one intermediate sleeve and the lower sleeve comprising first and/or second displacement means so that they are rotatably and axially displaceable relative to each other so as to follow a restitution of the cosmetic product, the first and/or the second displacement means for displacing the at least one intermediate sleeve extending over the entire height of an external and/or internal surface of the at least one intermediate sleeve.

2. The refill according to claim 1, wherein the first displacement means allow a displacement of the upper sleeve relative to the at least one intermediate sleeve and the second displacement means allow a displacement of the at least one intermediate sleeve relative to the lower sleeve.

3. The refill according to claim 2, wherein the first displacement means for displacing the upper sleeve are disposed on all or part of an internal surface or of an external surface thereof and cooperate in sliding along a path defined by the first displacement means disposed respectively on the external surface or the internal surface of an adjacent intermediate sleeve.

4. The refill according to claim 2, wherein the second displacement means for displacing the lower sleeve are disposed on the external surface or on the internal surface thereof and define a path so that the second displacement means for displacing an adjacent intermediate sleeve disposed respectively on all or part of the internal surface or the external surface thereof cooperate in sliding along this path.

5. The refill according to claim 4, wherein the upper sleeve and an adjacent intermediate sleeve comprise a first blocking means so as to be rotationally secured, an unblocking being performed by a first torque C1.

6. The refill according to claim 5, wherein the lower sleeve and the adjacent intermediate sleeve comprise a second blocking means so as to be secured in rotation, an unblocking being performed by a second torque C2.

7. The refill according to claim 6, wherein the first torque C1 is less than the second torque C2 such that a sequential axial displacement of the sleeves is ensured upon the rotational displacement of at least one of the upper, lower and/or intermediate sleeves.

8. The refill according to claim 1, wherein the upper sleeve, the lower sleeve and the at least one intermediate sleeve are of single material.

9. The refill according to claim 1, wherein the first displacement means comprise protrusions allowing for controlling the restitution of the cosmetic product.

10. The refill according to claim 1, wherein the upper, lower and intermediate sleeves form a longitudinal wall delimiting a volume V into which the cosmetic product is poured through an open lower end of the lower sleeve, the open lower end of the lower sleeve being sealed by a plug once the cosmetic product has been poured.

11. The refill according to claim 1, wherein upper and lower ends of the at least one intermediate sleeve have sealing areas cooperating with the upper sleeve and/or the lower sleeve.

12. The refill according to claim 1, further comprising an envelope configured to cover at least the at least one intermediate sleeve and the lower sleeve.

13. The refill according to claim 1, wherein the lower sleeve comprises an axially extending lower internal skirt configured to removably attach with the base of the receptacle.

14. A receptacle for a cosmetic product comprising a refill according to claim 1 and a base allowing for the removable attachment of said refill.

15. The receptacle according to claim 14, comprising a coding between the base and the refill such that the base and/or the refill are configured so as to be specific of each other.

16. The receptacle according to claim 14, further comprising an envelope configured to cover at least the at least one intermediate sleeve.

* * * * *